US008771475B1

(12) United States Patent
Gibson et al.

(10) Patent No.: US 8,771,475 B1
(45) Date of Patent: Jul. 8, 2014

(54) INTERTWINED TUBE COIL ARRANGEMENT FOR A DELAYED COKER HEATER

(75) Inventors: William C. Gibson, Tulsa, OK (US); Robert L. Gibson, Broken Arrow, OK (US)

(73) Assignee: Great Southern Independent LLC, Broken Arrow, OK (US)

( * ) Notice: Subject to any disclaimer, the term of this patent is extended or adjusted under 35 U.S.C. 154(b) by 756 days.

(21) Appl. No.: 12/622,062

(22) Filed: Nov. 19, 2009

(51) Int. Cl.
*C10G 9/20* (2006.01)

(52) U.S. Cl.
USPC ..... 196/116; 196/117; 196/120; 122/6 R; 122/511; 208/132

(58) Field of Classification Search
USPC ..... 196/116, 117, 120; 122/6 R, 511; 208/132
See application file for complete search history.

(56) References Cited

U.S. PATENT DOCUMENTS

| | | | | |
|---|---|---|---|---|
| 4,986,222 | A * | 1/1991 | Pickell et al. | 122/6 R |
| 6,237,545 | B1 * | 5/2001 | Barnett et al. | 122/235.23 |
| 6,241,855 | B1 * | 6/2001 | Gibson et al. | 202/124 |
| 2004/0175663 | A1 * | 9/2004 | Melton et al. | 431/9 |

* cited by examiner

*Primary Examiner* — Renee E Robinson
(74) *Attorney, Agent, or Firm* — Gable Gotwals

(57) ABSTRACT

A tube coil for a double fired coker heater wherein the tube coil has at least two independent flow passes in an intertwined serpentine pattern. The tubes are located in a common plane and plumbed in parallel with one another. These tube coils can be used in a number of configurations within the radiant section of a coker heater.

10 Claims, 3 Drawing Sheets

Prior Art

INTERTWINED TUBE COIL ARRANGEMENT FOR A DELAYED COKER HEATER

REFERENCE TO PENDING APPLICATIONS

This application is not based upon any pending domestic or international patent applications.

REFERENCE TO MICROFICHE APPENDIX

This application is not referenced in any microfiche appendix.

FIELD OF THE INVENTION

The present invention is generally directed towards a double fired delayed coker heater. More specifically, the present invention provides an improved tube coil layout for a delayed coker heater.

BACKGROUND OF THE INVENTION

In the petroleum refining process coker heaters are used to heat vacuum bottoms being refined in order to form gas, gas oil, and petroleum coke. One of the more common types of coker heaters is a double fired coker heater. The double fired coker heater of the prior art typically has one or more tube bundles located within the radiant section of a heater. One or more burners are located on each side of the tube coil. The burners provides the radiant heat to heat the fluid passing through the tube bundle.

The prior art tube bundles have a single flow path with tubes and fittings creating a serpentine pattern. The fluid being heated is allowed to pass through this coil while the burners provide the radiant heat source.

Oil refineries are complex facilities often times with very limited space. Over the years as a refinery is expanded, the competition for this limited space becomes ever increasing. One of the drawbacks of the prior art tube design is that it requires an excessive amount of area to locate the coker heater. Each serpentine coil arrangement contains only one process pass. This means a separate coil (line of tubes) must be added for each pass. As the number of coils increase so does the size of the coker heater and the area need to locate the coker heater.

One of the factors that complicates this situation is that the coker heater must be in relative close proximity to the coke drums. If the coker heater is located too far away from the drum the pressure drop associated with the transfer line can become excessive. Increasing the outlet pressure of the coker heater increases the rate of fouling and reduces the run length. Often times additional space is available at the refinery, however it is too far from the coke drums to be a suitable location for a coker heater.

What is needed is a tube coil design which allows for a more compact coker heater.

Hence what is needed is a coker heater and tube design which can have increased heater capacity with reduced area or footprint.

Another drawback to the prior art tube bundles is that they lead to larger coker heaters. In addition to taking up more space they are also more expensive to construct and operate.

BRIEF SUMMARY OF THE INVENTION

The present invention is a tube coil for a double fired coker heater wherein the tube coil has at least two independent flow paths configured in an intertwined serpentine pattern. The tubes are located in a common plane and plumbed in parallel with one another. These tube coils can be used in a number of configurations within the radiant section of a coker heater.

The present invention provides a tube coil arrangement with multiple passes.

Further the present invention provides a tube coil with a more dense number of passes per available area of plot space. Thus allowing for a coker heater to have a smaller footprint than the prior art.

Additionally the present invention reduces coker heater construction costs by reducing the overall size of the heater.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
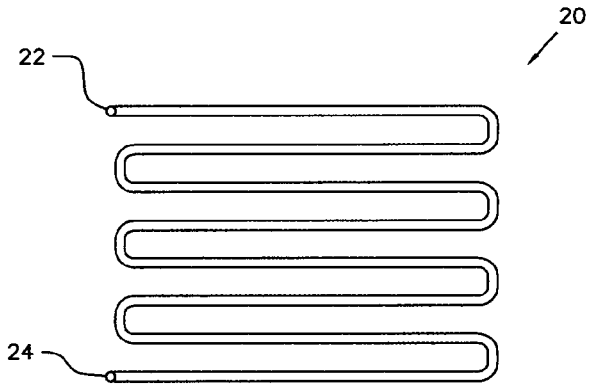
FIG. 1 is a schematic showing the typical prior art tube coil.
Figure 2:
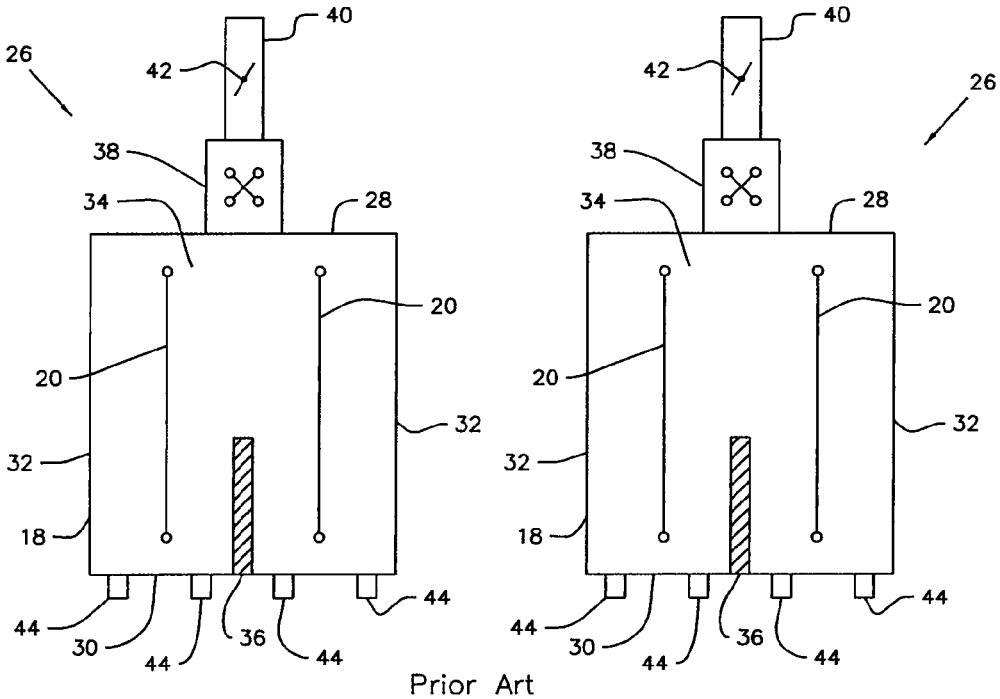
Prior Art Fig. 2
FIG. 2 is a schematic sectional end view of a pair of typical prior art double fired coker heaters with gravity brick walls.

Turning now to FIG. 1 which shows the coil configuration for a typical prior art coil 20. The coil 20 has a single tube or flow pass with an inlet 22 and an outlet 24. FIG. 2 shows these prior art coils 20 located in the radiant section 18 of a pair of typical prior art coker heaters 26. Each radiant section 18 has a top 28, a bottom 30, a pair of opposing side walls 32 and a pair of opposing end walls 34. All of these combine to define the interior volume of the radiant section.

The coils 20 are located on either side of a gravity brick wall 36. The gravity brick wall 36 is typically constructed out of refractory brick or other fire retardant materials. A plurality of burners 44 are located in the bottom 30 of the radiant section 18, on either side of the coil 20. The overall length of the coker heater 26 can vary such that the radiant surface area can be increased up to an approximate maximum tube length of 75 feet. Additional burners 44 can also be placed along the length of the coil 20 for increasing the heater capacity. The coker heater 26 is also provided with a convection section 38 and a stack 40 with a damper 42.

When in use fluid is passed through each of the coils 20. Each of these coils 20 is piped to be in parallel with each other such that the fluid only passes through one of the coils 20. Fuel is provided to the burners 44 to create combustion. The radiant heat transfers into the fluid passing through the coils 20. The majority of the heat entering the fluid in the radiant section 18 is via radiant heat transfer.

Once the fuel has been combusted in the radiant section 18 the heat and products of combustion rise up through the convection section 38 where additional transfer of heat into the fluid is achieved primarily through convective heat transfer. These hot gases eventually pass through the stack 40. From there these flue gases are either further processed to reduce pollutants and/or increase heater efficiency or they are exhausted into the atmosphere. The flow rate of the flue gas and the draft inside the heater can be adjusted via the dampers 42.

Figure 3:
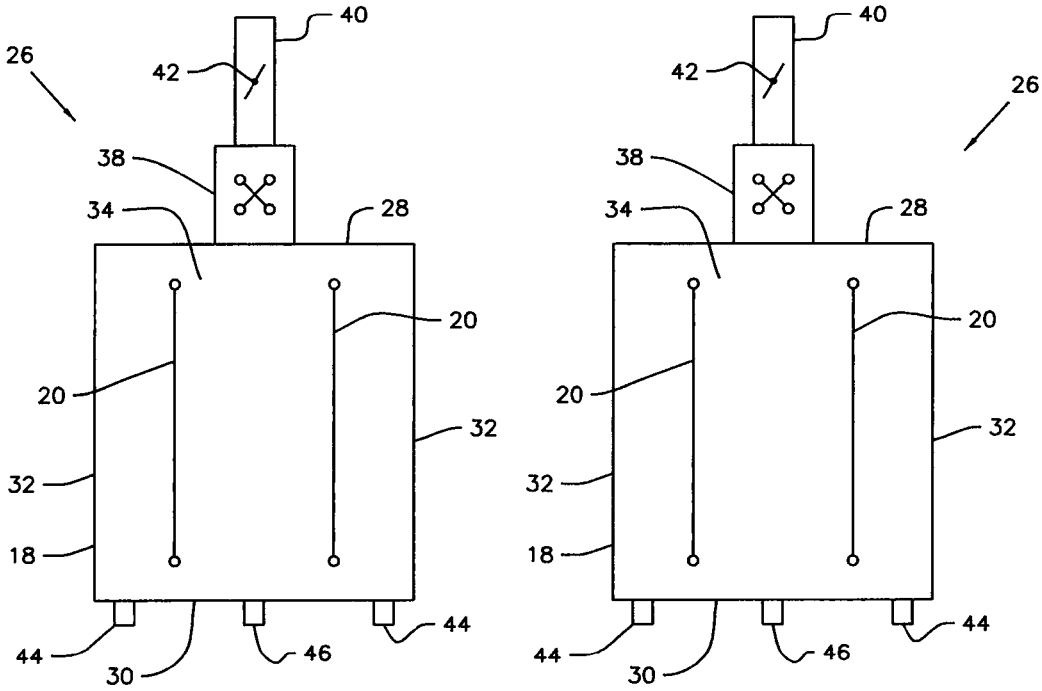
FIG. 3 is a schematic sectional end view of a pair of typical prior art double fired coker heaters.

FIG. 3 shows another prior art coker heater arrangement. This second arrangement differs from the first in that a gravity brick wall 36 is not employed. Once again the prior art coils 20 are located parallel with one another within the confines of the radiant section 18. Additional coil area can be located along the same plane by increasing the length of the radiant tubes.

In this heater arrangement, a row of burners 44 are located along the outer sides of the coils 20. A single row 46 of burners are located between the coils 20. While the heat from the various burners can be varied, in this arrangement the center row of burners 46 typically burn approximately twice as much fuel than the outer row of burners 44.

Figure 4:
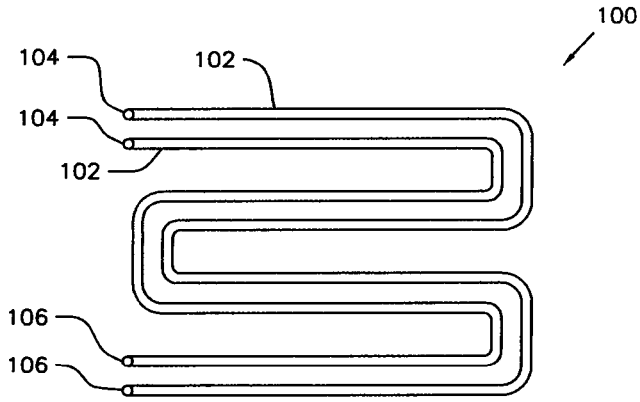
Prior Art Fig. 4
FIG. 4 is a schematic of the tube coil of the present invention.

Turning now to FIG. 4, the coil bundle 100 of the present invention has two or more tubes or flow passes 102 intertwined with one another on a plane. FIG. 4 shows the tubes 102 wound in a serpentine manner, however other patterns could be employed. The tubes 102 are located on a common plane. Each tube 102 has an inlet 104 and an outlet 106.

Figure 5:
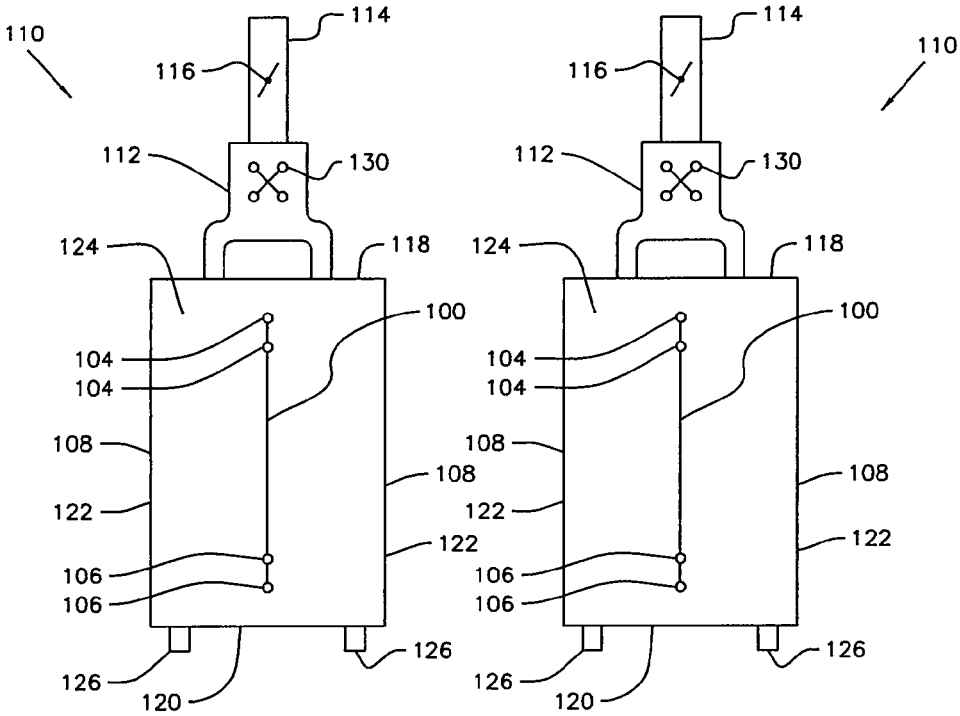
FIG. 5 is a schematic sectional end view of a pair of double fired coker heaters each having the present invention tube coils.

Turning now to FIG. 5, the coils 100 of the present invention are shown mounted in the radiant section 108 of a coker heater 110. When installed in the radiant section 108, the tubes 102 are plumbed in a parallel configuration such that each tube 102 has its individual flow of fluid. So, the same fluid cannot pass through both tubes 102 of the tube coil 100.

The coker heater 110 of the present invention has a radiant section 108, a convection section 112 and a stack 114 with a damper 116. The radiant section has a top 118, a bottom 120, a pair of opposing side walls 122 and a pair of opposing end walls 124 all of which define the interior volume of the radiant section 108. A plurality of burners 126 are located in the bottom 120 of the radiant section 108 on either side of the coil 100. Additional surface area to coils 100 can be located in the radiant section 108. This additional surface area can be added by extending the length of the coil 100.

Figure 6:
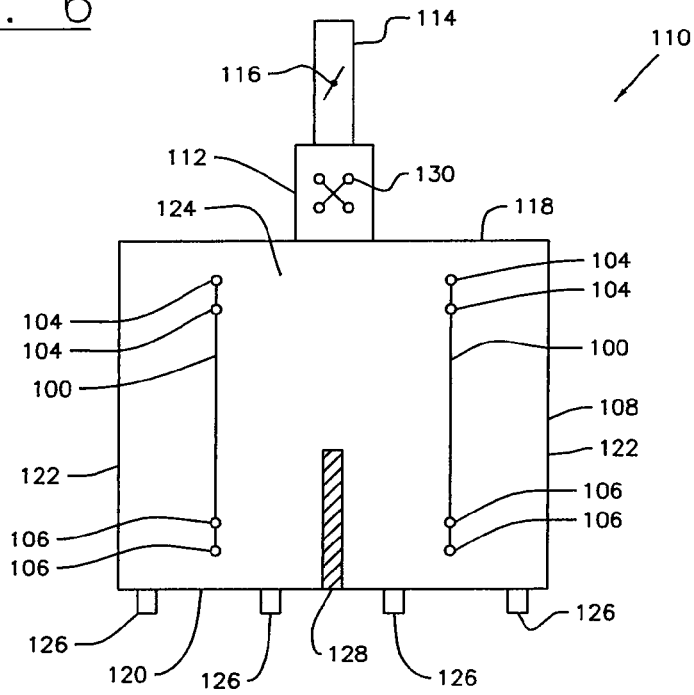
FIG. 6 is a schematic end view of a double fired coker heater having a pair of the present invention tube coils separated by a gravity brick wall.

Turning now to FIG. 6, another configuration of a coker heater 110 with a radiant section 108, convection section 112, stack 114 and damper 116. The radiant section 108 has a top 118, a bottom 120, a pair of opposing sidewalls 122 and a pair of opposing end walls 124 two tube coils 100 of the present invention are installed in a radiant section 108 of a coker heater 110 separated by a gravity brick wall 128. The gravity brick wall can be constructed out of refractory brick or any other fire retardant material.

At least one burner 126 is located on either side of the tube coils 100. Additional burners 126 can be located along the length of the coil 100. The exact number, size and location of the burners 126 are determined on a case by case basis dependent upon the details of the specific application.

When the present invention is in operation an individual parallel flow of fluid is pumped through tubes 102 of the tube coil 100. The fluid enters the respective tubes through the inlet 104 and exits the outlet 106. Radiant heat is provided by combustion of fuel in the burners 126. The radiant heat passes through the tubes 102 and heats the fluid as the fluid passes through the tubes 102.

The heat and products of combustion pass into the convection section 112 where convective heat transfer is used to heat the fluid passing through the tubes 130 located therein. The products of combustion then pass through the stack 114. The flow of the products of combustion can be regulated through operation of the damper 116.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A coker heater comprising:

a radiant section with a top, a bottom, a pair of opposing end walls and a pair of opposing side walls;

a tube coil with at least two independent tubes; and at least two burners;

wherein said tubes configured in an intertwined serpentine pattern; and said tubes are located in a common plane.

2. The coker heater of claim 1, further comprising said tubes being plumbed in parallel with one another.

3. The coker heater of claim 1 further comprising a convection section and a stack, wherein said radiant section, said convection section and said stack are in fluid communication with one another.

4. The coker heater of claim 1 further comprising:

a second tube coil;

a gravity brick wall located along a straight line between said first tube coil and said second tube coil;

said second tube coil having at least two independent tubes.

5. The coker heater of claim 4, further comprising said tubes of said second tube coil being plumbed in parallel.

6. The coker heater of claim 4, further comprising said tubes of said second tube coil being configured in an intertwined serpentine pattern.

7. The coker heater of claim 4, further comprising said tubes of said second coil being on a common plane.

8. A coker heater comprising:

a stack with a damper;

a convection section;

a radiant section with a top, a bottom, a pair of opposing end walls, a pair of opposing side walls, a tube coil with at least one burner located on both sides;

wherein said tube coil has at least two independent tubes, said tubes are configured in an intertwined serpentine pattern located on a common plane and plumbed in parallel.

9. The coker heater of claim 8, further comprising a second tube coil;

a gravity brick wall located along a straight line between said first tube coil and said second tube coil;

said second tube coil having at least two independent tubes; said tubes are configured in an intertwined serpentine pattern located on a second common plane and plumbed in parallel.

10. A coker heater comprising:

a stack with a damper;

a convection section;

a radiant section with a top, a bottom, a pair of opposing end walls, a pair of opposing side walls, a first and a second tube coil with at least one burner located on both sides of each tube coil;

wherein said first tube coil has at least two independent tubes, said tubes are configured in an intertwined serpentine pattern located on a common plane and plumbed in parallel; and said second tube coil having at least two independent tubes; said tubes are configured in an intertwined serpentine pattern located on a second common plane and plumbed in parallel.

* * * * *